US012781736B2

(12) United States Patent
Hayes-Pankhurst et al.

(10) Patent No.: US 12,781,736 B2
(45) **Date of Patent: *Nov. 3, 2026**

(54) PUMPS WITH ROTORS HAVING RECESSES AND PASSAGEWAYS

(71) Applicant: PSG Germany GmbH, Duisburg (DE)

(72) Inventors: Richard Paul Hayes-Pankhurst, London (GB); Jonathan Edward Ford, London (GB)

(73) Assignee: PSG Germany GmbH, Duisburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 19/027,610

(22) Filed: Jan. 17, 2025

(65) Prior Publication Data

US 2025/0154953 A1 May 15, 2025

Related U.S. Application Data

(63) Continuation of application No. 18/560,359, filed as application No. PCT/EP2022/062978 on May 12, 2022, now Pat. No. 12,203,474.

(30) Foreign Application Priority Data

May 12, 2021 (GB) ..... 2106742

(51) Int. Cl.
*F04C 5/00* (2006.01)
*F04C 2/22* (2006.01)

(52) U.S. Cl.
CPC ..... *F04C 5/00* (2013.01); *F04C 2/22* (2013.01); *F04C 2240/10* (2013.01); (Continued)

(58) Field of Classification Search
CPC ..... F04C 5/00; F04C 2/22; F04C 18/22
See application file for complete search history.

(56) References Cited

U.S. PATENT DOCUMENTS 6,976,832 B1 * 12/2005 Wheeler ..... F04C 2/46 418/268
12,203,474 B2 * 1/2025 Hayes-Pankhurst ..... F04C 5/00
(Continued)

FOREIGN PATENT DOCUMENTS

GB 2507029 4/2014
JP 2008-512595 A 4/2008
(Continued)

OTHER PUBLICATIONS

International Preliminary Report on Patentability in International Appln. No. PCT/EP2022/062978, mailed on Nov. 23, 2023, 9 pages.
(Continued)

*Primary Examiner* — Laert Dounis
(74) *Attorney, Agent, or Firm* — Fish & Richardson P.C.

(57) ABSTRACT

The present application relates to pumps including: a first fluid port and a second fluid port, a housing having an interior surface defining a cavity, a rotor, being rotatably mounted within the housing, and comprising, a housing engaging surface area, and a surface recess that, a resiliently deformable diaphragm providing part of the interior surface of the housing, the rotor comprising an elongate body and a drive shaft, which body is substantially hollow and comprises separate first and second rotor cavities, the pump being arranged such that when the rotor body is located within the housing cavity, the first fluid port is in fluid flow communication with the first rotor cavity via the opening at the first end of the rotor, and the pump being arranged such that the resiliently deformable diaphragm always bisects the first opening and the second opening on the rotor surface recess as the rotor rotates.

20 Claims, 7 Drawing Sheets

(52) U.S. Cl.
CPC ..... *F04C 2240/20* (2013.01); *F04C 2240/30* (2013.01); *F04C 2240/811* (2013.01)

(56) References Cited

U.S. PATENT DOCUMENTS

| | | | |
|---|---|---|---|
| 2006/0051228 | A1 | 3/2006 | Hayes-Pankhurst et al. |
| 2014/0255164 | A1 | 9/2014 | Hayes-Pankhurst et al. |
| 2014/0348684 | A1 | 11/2014 | Hayes-Pankhurst et al. |
| 2015/0260195 | A1 * | 9/2015 | Hayes-Pankhurst ..... F04C 15/0015 415/173.1 |
| 2016/0010634 | A1 | 1/2016 | Hayes-Pankhurst et al. |
| 2016/0010643 | A1 | 1/2016 | Hayes-Pankhurst |
| 2018/0073503 | A1 | 3/2018 | Hayes-Pankhurst et al. |
| 2019/0048871 | A1 | 2/2019 | Hayes-Pankhurst et al. |

FOREIGN PATENT DOCUMENTS

| | | | |
|---|---|---|---|
| JP | 2012-524864 | A | 10/2012 |
| JP | 2013-521990 | A | 6/2013 |
| JP | 2014-528542 | A | 10/2014 |
| JP | 2015-507131 | A | 3/2015 |
| WO | WO 2000/73627 | | 12/2000 |
| WO | WO 2006/027548 | | 3/2006 |
| WO | WO 2010/122299 | | 10/2010 |
| WO | WO 2013/050491 | | 4/2013 |
| WO | WO 2013/117486 | | 8/2013 |
| WO | WO 2014/060418 | | 4/2014 |
| WO | WO 2014/135563 | | 9/2014 |
| WO | WO-2015001571 | A2 * | 1/2015 ..... F04C 2/22 |

OTHER PUBLICATIONS

International Search Report and Written Opinion in International Appln. No. PCT/EP2022/062978, mailed on Sep. 7, 2022, 16 pages.
Extended European Search Report in European Appln. No. 25169304.0, mailed on Jul. 1, 2025, 7 pages.
Office Action in Japanese Appln. No. 2023-570007, mailed on Mar. 3, 2026, 4 pages (with English translation).
Office Action in Japanese Appln. No. 2023-570007, mailed on May 11, 2026, 3 pages (with English translation).
Office Action in Chinese Appln. No. 202280049485.6, mailed on Jul. 30, 2026, 9 pages (with English translation).

* cited by examiner

PUMPS WITH ROTORS HAVING RECESSES AND PASSAGEWAYS

This application is a continuation of U.S. patent application Ser. No. 18/560,359 filed Nov. 10, 2023, which is a National Stage application under 35 U.S.C. § 371 of International Application No. PCT/EP2022/062978, having an International Filing Date of May 12, 2022, which claims the benefit of GB Serial No. 2106742.6 filed May 12, 2021. This disclosure of the prior applications are considered part of (and are incorporated by reference in) the disclosure of this application.

The invention relates to pumps, in particular to rotary pumps.

It is known to provide a pump formed by a housing having an inlet and outlet for a fluid and containing a rotor provided with at least one surface recess that forms with the interior surface of the rotor a chamber that, on rotation of the rotor, conveys fluid from the inlet to the outlet. In order to prevent fluid passing from the outlet to the inlet, a flexible diaphragm is provided on or as part of the housing and is located between the inlet and the outlet. The diaphragm is urged into engagement with the rotor by a pressurising means, which can take many forms such as a block of resilient material, a resilient tube of material, a spring or hydraulic or pneumatic pressure. Pumps of this general kind are disclosed in International patent application number WO2006/027548.

Since such pumps comprise a discrete number of chambers formed by recesses in the rotor surface conveying fluid from an inlet to an outlet, the resulting liquid flow tends to be pulsated, with periods of no flow and periods of high flow. This can be detrimental in some applications, for example, in administering medicine to a patient, where a pulsating flow can be uncomfortable. It is an object of the present invention to provide a pump with improved flow profile.

Attempts have been made to reduce pulsing of fluid flow in pumps such as the rotary infusion pump described in International patent application number WO2011/119464. This document discloses a pump having a housing containing a rotor, wherein the rotor includes a first ring of surfaces that form channels with the housing and a second ring of surfaces that form channels with the housing. The first and second rings being radially offset to dampen pulsing of the flow of fluid through the pump.

There is always a desire to provide smaller pumps with higher throughput. It is an object of preferred embodiments of the present invention to provide a rotary pump with higher throughput for a given size. It is also desirable to improve flow rate to power efficiency.

Furthermore, it is important to be able to sterilise pumps in many applications, in order that they may be used as part of a single use system. It is an objective of the present invention to provide a pump which can be more easily sterilised.

It is an objective of preferred embodiments of the present invention to provide a rotary pump providing essentially continuous flow. Continuous flow as used herein is defined as a flow where there are no periods of no fluid flow. Continuous flow does not necessarily mean that there is a constant flow rate, there may be some variation in flow rate provided there is always a positive flow of fluid while the pump is operational and supplied with fluid.

Aspects of the invention described herein may be useful alone or in combination with another aspect described herein.

According to a first aspect of the present invention, there is provided a pump comprising, a first fluid port and a second fluid port, a housing having an interior surface defining a cavity in which a rotor is located, a rotor, being rotatably mounted within the housing and having a longitudinal axis of rotation, and comprising, a housing engaging surface area forming a sealing interference fit with the interior surface of the housing, and a surface recess that forms with said interior surface of the housing a fluid-conveying chamber that, on rotation of the rotor, conveys fluid from the first fluid port to the second fluid port, a plurality of resiliently deformable diaphragms each providing part of the interior surface of the housing, each diaphragm comprising a rotor engaging surface and a rear surface opposite the rotor engaging surface, the rotor engaging surface of each diaphragm being urged into contact with the rotor by the action of a pressurising means acting on the rear surface of the diaphragm, the number of resiliently deformable diaphragms exceeding the number of surface recesses on the rotor, the rotor comprising an elongate body and a drive shaft, which elongate body is substantially hollow and comprises separate first and second rotor cavities, the first rotor cavity having an opening at a first end of the rotor and the second rotor cavity having an opening at a second end of the rotor, the rotor body further comprising a first opening between the first rotor cavity and the surface recess and a second opening between the surface recess and the second rotor cavity, the pump being arranged such that when the rotor body is located within the housing cavity, the first fluid port is in fluid flow communication with the first rotor cavity via the opening at the first end of the rotor, and the second fluid port is in fluid flow communication with the second rotor cavity via the opening at the second end of the rotor, and the pump being arranged such that at least one of the resiliently deformable diaphragms always bisects the first opening and the second opening on the rotor surface recess as the rotor rotates.

According to second aspect of the invention, there is provided a pump comprising, a first fluid port and a second fluid port, a housing having an interior surface defining a cavity in which a rotor is located, a rotor, being rotatably mounted within the housing and having a longitudinal axis of rotation, and comprising, a housing engaging surface area forming a sealing interference fit with the interior surface of the housing, and a surface recess that forms with said interior surface of the housing a fluid-conveying chamber that, on rotation of the rotor, conveys fluid from the first fluid port to the second fluid port, the rotor being twisted about the longitudinal axis of rotation thereof, such that a first end and a second end of the rotor are rotationally off-set relative to one another by at least 10 degrees, a resiliently deformable diaphragm providing part of the interior surface of the housing, the diaphragm comprising a rotor engaging surface and a rear surface opposite the rotor engaging surface, the rotor engaging surface of the diaphragm being urged into contact with the rotor by the action of a pressurising means acting on the rear surface of the diaphragm, the rotor comprising an elongate body and a drive shaft, which body is substantially hollow and comprises separate first and second rotor cavities, the first rotor cavity having an opening at a first end of the rotor and the second rotor cavity having an opening at a second end of the rotor, the rotor body further comprising a first opening between the first rotor cavity and the surface recess and a second opening between the surface recess and the second rotor cavity, the pump being arranged such that when the rotor body is located within the housing cavity, the first fluid port is in fluid flow communication with the first rotor cavity via the opening at the first end of the rotor, and the second fluid port is in fluid flow communication with the second rotor cavity via the opening at the second end of the rotor, and the pump being arranged such that the resiliently deformable diaphragm always bisects the first opening and the second opening on the rotor surface recess as the rotor rotates.

According to a third aspect of the invention, there is provided a pump comprising, a first fluid port and a second fluid port, a housing having an interior surface defining a cavity in which a rotor is located, a rotor, being rotatably mounted within the housing and having a longitudinal axis of rotation, and comprising, a housing engaging surface area forming a sealing interference fit with the interior surface of the housing, and a surface recess that forms with said interior surface of the housing a fluid-conveying chamber that; on rotation of the rotor, conveys fluid from the first fluid port to the second fluid port, a resiliently deformable diaphragm providing part of the interior surface of the housing, the diaphragm comprising a rotor engaging surface and a rear surface opposite the rotor engaging surface, the rotor engaging surface of the diaphragm being urged into contact with the rotor by the action of a pressurising means acting on the rear surface of the diaphragm, a linear rib upstanding from either the rear surface of the resiliently deformable diaphragm or acting on the rear surface of the diaphragm, the linear rib being angled relative to the longitudinal axis of rotation of the rotor by at least 10 degrees, the rotor comprising an elongate body and a drive shaft, which body is substantially hollow and comprises separate first and second rotor cavities, the first rotor cavity having an opening at a first end of the rotor and the second rotor cavity having an opening at a second end of the rotor, the rotor body further comprising a first opening between the first rotor cavity and the surface recess and a second opening between the surface recess and the second rotor cavity, the pump being arranged such that when the rotor body is located within the housing cavity, the first fluid port is in fluid flow communication with the first rotor cavity via the opening at the first end of the rotor, and the second fluid port is in fluid flow communication with the second rotor cavity via the opening at the second end of the rotor, and the pump being arranged such that the resiliently deformable diaphragm always bisects the first opening and the second opening on the rotor surface recess as the rotor rotates.

Suitably, in all aspects of the invention the housing comprises a resilient material, for example, polypropylene, polyethylene, thermoplastic polyurethane or rubber. The first fluid port and/or the second fluid port may extend from the housing. If the first fluid port and/or the second fluid port extend from the housing, the first and/or second fluid port are suitably moulded with the housing.

The rotor may be made from a rigid material such as stainless steel, polyether ether ketone (PEEK), high density polyethylene (HDPE) or polycarbonate. The choice of material of the housing and rotor are interdependent and should be chosen such that there is a low coefficient of friction between the contacting surfaces of the housing and the rotor.

According to all aspects of the invention; the housing may comprise a single unit providing the interior surface defining the cavity in which the rotor is located, the first fluid port and the second fluid port and optionally one or more resiliently deformable diaphragms. Alternatively, the housing may provide the interior surface defining the cavity in which the rotor is located, and optionally one or more resiliently deformable diaphragms, and may be used with a first and/or second separate end caps to close the cavity in which the rotor is located. In this embodiment, the first and/or second fluid port may be provided in the housing or in a separate end cap.

A pump according to the second or third aspects of the present invention may comprise one resiliently deformable diaphragm.

Alternatively, a pump according to the second or third aspects of the present invention may comprise a plurality of resiliently deformable diaphragms. A pump according to any aspect of the present invention may comprise any suitable number of resiliently deformable diaphragm. In a preferred embodiment of any aspect of the invention, the pump comprises two resiliently deformable diaphragms. In an alternative preferred embodiment of any aspect of the invention, the pump comprises three resiliently deformable diaphragms. If the pump comprises a plurality of resiliently deformable diaphragms, they are preferably equidistantly arranged about the circumference of the rotor.

In all aspects of the invention, one or all of the resiliently deformable diaphragms are suitably provided by a section of the housing manufactured to a sufficiently small thickness to have the required deformable resilience. For example, a resiliently deformable diaphragm is provided by a section of the housing that is no more than 1 mm, suitably no more than 0.5 mm and in some embodiments less than 0.1 mm thick. In this embodiment, the housing is preferably made from a resilient thermoplastic or thermoset material and each resiliently deformable diaphragm is unitary with the housing.

Alternatively, in all aspects of the invention one or all of the resiliently deformable diaphragms may comprise a section of resiliently deformable elastomeric material which is hermetically attached to or co-moulded with the housing, The separate diaphragm should be attached to the housing so as to create a hermetic and continuous rotor engaging surface as the interior surface of the housing, suitably comprising an elastomeric material such as a thermoplastic elastomer (TPE), or a thermoplastic polyurethane (TPU). If a diaphragm is provided by a separate resiliently deformable elastomeric material, the housing may comprise a resilient material, for example, polypropylene, polyethylene, thermoplastic polyurethane or rubber or the housing could be made of a rigid material.

In use according to all aspects of the invention, each diaphragm forms a fluid-tight contact between the rotor-engaging surface of the diaphragm and the rotor surface. Furthermore, the resiliently deformable nature of each diaphragm means that each diaphragm conforms to the contoured surface of the rotor, such that, in use, each diaphragm is operable to displace fluid from the fluid-conveying chamber as the rotor rotates.

In embodiments of the first and second aspects of the invention, one or each of the resiliently deformable diaphragms may comprise a linear rib protruding from the rear surface thereof. Alternatively, a rib may be provided on a spring means providing the pressurising means, arranged such that in use it acts on the rear surface of one or each of the diaphragms. In embodiments of the first or second aspects of the invention, the rib extends along the full length of the diaphragm in a direction parallel to the longitudinal axis of rotation of the rotor. Alternatively, in embodiments of the first or second aspects of the invention, the linear rib extends along the full length of the diaphragm and is angled relative to the longitudinal axis of rotation of the rotor by at least 10 degrees.

In all aspects of the invention, any suitable pressurising means may be used to urge the rotor engaging surface of each diaphragm into contact with the rotor. The pressurising means may comprise a spring means acting on the rear surface of the one or each resiliently deformable diaphragm. For example, a pressurising means may comprise a block or tube of resilient material, to which pressure may be applied to urge the spring means against the rear surface of one or each resiliently deformable diaphragm. Examples of suitable spring members are disclosed in International patent application number WO2013/117486. Alternatively, or in addition, the pressurising means may comprise a fluid applied to the rear surface of one or each resiliently deformable diaphragm. Examples of pumps comprising fluid applied to the rear surface of the resiliently deformable diaphragm are disclosed in International patent application numbers WO2010/122299 and WO 2014/135563.

In embodiments of all aspects of the invention, a pump according to the invention may comprise a diaphragm chamber surrounding the rear surface of a resiliently deformable diaphragm.

In all aspects of the invention, the diaphragm chamber may be provided by walls extending from the housing and suitably comprises a separate cap to close the chamber. Alternatively, the diaphragm chamber may comprise a separate unit that is attached to the housing. The diaphragm chamber suitably houses the pressurising means arranged to urge the resiliently deformable diaphragm against the rotor. Each diaphragm chamber may comprise either an open chamber or a closed chamber for locating the pressurising means. The closed chamber may be hermetically sealed.

In embodiments of all aspects of the invention, the diaphragm chamber may be a closed chamber connected by a passage to the fluid flowing through the pump, such that fluid flowing through the pump provides the pressurising means. The passage providing fluid to the diaphragm chamber may comprise a one-way valve, allowing fluid to flow into the diaphragm chamber, but not out. This one-way valve arrangement allows for sustained pressure on the diaphragm once the diaphragm chamber is charged with fluid, even if the direction of flow of the pump is reversed.

Alternatively, in embodiments of all aspects of the invention, the diaphragm chamber may be a closed chamber connected by a passage to a separate fluid source, which separate fluid source provides the pressurising means.

In embodiments of all aspects of the invention, the second fluid port may extend from the diaphragm chamber. Furthermore, if the diaphragm chamber comprises a separate cap to close the chamber, the second fluid port may extend from the cap.

In embodiments of all aspects of the invention, a diaphragm chamber surrounds only one resiliently deformable diaphragm. Alternatively, an individual diaphragm chamber may surround the rear surface of each of the resiliently deformable diaphragms.

In an alternative embodiment of all aspects of the invention, each resiliently deformable diaphragm is surrounded by separate diaphragm chambers, with a plurality of diaphragm chambers being inter-connected; thereby effectively producing a single diaphragm chamber. The plurality of diaphragm chambers may be interconnected by providing a fluid channel between the chambers. This is particularly useful if the second fluid port of the pump extends from a diaphragm chamber and/or if fluid from the second rotor cavity provides the pressurising means.

In all aspects of the invention, the rotor is generally cylindrical and comprises at least one recess that forms with the interior surface of the housing a fluid-conveying chamber. In all aspects of the invention, the surface recess is provided by a concave area of the rotor surface. In all aspects of the invention, the surface recess preferably extends longitudinally along the majority of the axial length of the rotor. In a preferred embodiment, the surface recess does not extend along the whole axial length of the rotor, but preferably extends longitudinally along substantially the whole of the axial length of the rotor. In embodiments where the rotor comprises a plurality of recesses, the plurality of recesses are separate and do not intersect.

In embodiments of all aspects of the invention, the rotor may have a plurality of surface recesses that form, with said interior surface of the housing, a corresponding plurality of fluid-conveying chambers that, on rotation of the rotor, convey fluid from the first fluid port to the second fluid port. For example, the rotor may have two surface recesses that form with said interior surface of the housing two fluid-conveying chambers. In an alternative embodiment of all aspects of the invention, the rotor has three surface recesses that form with said interior surface of the housing three fluid-conveying chambers. The rotor may have four surface recesses that form with said interior surface of the housing four fluid-conveying chambers. Furthermore, the rotor may have five surface recesses that form with said interior surface of the housing five fluid-conveying chambers. Whilst the rotor of all aspects of the invention may comprise any number of recesses providing a corresponding number of fluid-conveying chambers, the more chambers there are the smaller the volume of fluid that can be conveyed in each chamber for a given rotor diameter and length.

Preferably, if a pump according to any aspect of the invention comprising a plurality of surface recesses, the plurality of surface recesses are arranged circumferentially about the rotor. Preferably, the plurality of surface recesses are equidistantly spaced about the circumference of the rotor. In all aspects of the invention, the plurality of recesses are not arranged longitudinally along the axial length of the rotor.

In embodiments of all aspects of the present invention the rotor may have two recesses and a generally cylindrical shape with a circular cross section at each end and an elliptical cross-section in the centre.

In an alternative embodiment of all aspects of the invention, the rotor may have three recesses with a circular cross section at each end and a generally triangular cross-section in the centre. In an alternative embodiment of all aspects of the invention, the rotor has four recesses with a circular cross section at each end and a generally square cross-section in the centre. In an alternative embodiment of all aspects of the invention, the rotor has five recesses with a circular cross section at each end and a generally pentagonal cross-section in the centre.

Suitably, the housing engaging surface area forming a sealing interference fit with the interior surface of the housing comprises the whole cylindrical surface of the rotor except the one or more surface recesses on the rotor. Preferably the rotor comprises a substantially cylindrical body in which one or more surface recesses are formed. The housing engaging surface area of the rotor suitably comprises a cylindrical area at each end of the rotor in which no surface recess is formed, which cylindrical areas are connected by elongate sections of the rotor surface separating the longitudinal extent of adjacent recesses. The cylindrical areas at the end of the rotor and the elongate sections between adjacent recesses are connected and in the same cylindrical plane defining the cylindrical surface of the rotor. The elongate sections of the rotor surface separating adjacent recesses provide a land between adjacent recesses on the rotor surface.

In embodiments of the second or third aspects of the present invention, the pump may comprise an equal number of resiliently deformable diaphragms and surface recesses on the rotor. For example, a pump according to the second or third embodiment of the invention may comprise two resiliently deformable diaphragms and two surface recesses on the rotor, forming two fluid-conveying chambers with the interior surface of the housing.

In other embodiments of the second or third aspects of the present invention, the number of resiliently deformable diaphragms exceeds the number of surface recesses on the rotor. For example, in accordance with all aspects of the invention, the pump may comprise three resiliently deformable diaphragms and two surface recesses on the rotor, forming two fluid-conveying chambers with the interior of the housing.

A pump comprising a plurality of diaphragm can advantageously operate at higher throughput compared to a pump with a single diaphragm. For example, a pump with two diaphragm and a rotor with two recesses will produce twice the flow of a pump with one diaphragm and a rotor with two recesses, because in one revolution each recess is emptied twice.

In all aspects of the present invention, the rotor comprising an elongate body, which body is substantially hollow and comprises a first rotor cavity and second rotor cavity. The first and second rotor cavities may be arranged consecutively along the length of the rotor. Alternatively, the first and second rotor cavities may extend longitudinally along the length of the rotor and be arranged alongside one another. Preferably, the first rotor cavity and the second rotor cavity are separated from each other by a bulkhead. If the first and second rotor cavities are arranged consecutively along the length of the rotor, the bulkhead suitably extends across the full cross-section of the interior of the rotor body. If the first and second rotor cavities are arranged alongside one another, the bulkhead suitably extends along the full length of the interior of the rotor body. If the bulkhead extends along the full length of the interior of the rotor body, it may be curved, staggered or angled, but the first and second rotor cavities must remain separated by the bulkhead. In all embodiments, the first rotor cavity and the second rotor cavity are not in direct fluid communication.

In all aspects of the invention, the first rotor cavity has an opening at a first end of the rotor to place the first fluid port and the first rotor cavity in direct fluid communication. In a preferred embodiment, the opening extends across substantially the whole of the first end of the first rotor cavity.

In all aspects of the invention, the second rotor cavity has an opening at the second end of the rotor to place the second rotor cavity in direct fluid communication with the second fluid port. In a preferred embodiment, the opening extends across substantially the whole of the second end of the second rotor cavity.

In all aspects of the invention, the rotor body comprising a first opening between the first rotor cavity and the surface recess and a second opening between the surface recess and the second rotor cavity. Preferably, the first opening and the second opening are each provided by a slot in the rotor body.

In embodiments of all aspects of the invention, the rotor may comprise a first groove and a second groove in the surface of the rotor extending along substantially the full length of opposing longitudinal edges of the surface recess, wherein the first opening between the first rotor cavity and the surface recess extends along a portion of the first groove that overlies the first rotor cavity and the second opening between the surface recess and the second rotor cavity extends along a portion of the second groove that overlies the second rotor cavity.

Suitably, in all aspects of the present invention, the first opening between the first rotor cavity and the surface recess is located adjacent and preferably contiguous with, an edge of the recess that forms the leading edge as the rotor rotates, and the second opening between the second rotor cavity and the surface recess is located adjacent and preferably contiguous with, an opposing edge of the recess that forms the following edge as the rotor rotates.

In an embodiment of all aspects of the invention, the first opening between the first rotor cavity and the surface recess extends along the full axial length of the surface recess that overlies the first rotor cavity and continues through the first end of the rotor. Alternatively, or in addition, in an embodiment of all aspects of the invention, the second opening between the surface recess and the second rotor cavity extends along the full axial length of the surface recess that overlies the second rotor cavity and through the second end of the rotor. In these embodiments, the first opening and/or the second opening will extend through the housing engaging surface area at the end of the rotor. Extending the first and/or second opening though the housing engaging surface area at the end of the rotor advantageously means the pumped fluid provides a lubricating and cooling effect between the housing engaging surface area of the rotor and the interior surface of the housing.

In embodiments of the first and third aspects of the invention, both the first opening and the second opening are substantially parallel to the longitudinal axis of rotation of the rotor.

In the second aspect of the invention, twisting the rotor has the effect of twisting the recesses on the rotor surface, as well as the first and second rotor cavities and the lands extending between the recesses. If the first opening between the first rotor cavity and the surface recess and a second opening between the surface recess and the second rotor cavity, is provided by a slot in the rotor body, these slots are also angled relative to the longitudinal axis of rotation of the rotor in the direction that the rotor is twisted. The slot and the land between the recesses are suitably substantially parallel.

In all aspects of the present invention, the first opening between the first rotor cavity and the surface recess extends along substantially the full axial length of the surface recess that overlies the first rotor cavity, and the second opening between the surface recess and the second rotor cavity extends along substantially the full axial length of the surface recess that overlies the second rotor cavity.

In all aspects of the present invention, the first opening between the first rotor cavity and the surface recess and the second opening between the surface recess and the second rotor cavity may be any suitable shape, for example the openings may be substantially linear, rectilinear, oval, elongated oval or tapered. Suitably, in all aspects of the present invention, the first opening between the first rotor cavity and the surface recess extends along the leading edge of the recess, substantially parallel to the land between adjacent recesses. Suitably, in all aspects of the present invention, the second opening between the second rotor cavity and the recess extends along the following edge of the recess, substantially parallel to the land between adjacent recesses. In both cases, the first opening and the second opening are preferably adjacent to the land.

In embodiments of all aspects of the present invention comprising a plurality of surface recesses, each surface recess suitably comprises a first opening between the first rotor cavity and the surface recess and a second opening between the second rotor cavity and the surface recess.

In all aspects of the present invention, the rotor drive shaft suitably extends from the hollow interior of the rotor body. The drive shaft may be a separate component that is fixed to the rotor or the drive shaft may be unitary with the rotor. The drive shaft preferably extends from the bulkhead formed in the interior of the rotor body separating the first rotor cavity and the second rotor cavity.

In embodiments of all aspects of the invention the rotor may be twisted about the longitudinal axis thereof, such that the first end and the second end of the rotor are off-set relative to one another by at least 10 degrees, or at least 15 degrees, or at least 20 degrees. In embodiments of all aspects of the invention the rotor may be twisted about the longitudinal axis thereof, such that the first end and the second end of the rotor are off-set relative to one another by no more than 45 degrees, or no more than 40 degrees.

In embodiments of the third aspect of the invention the linear rib may be angled relative to the longitudinal axis of rotation of the rotor by at least 10 degrees, or at least 15 degrees, or at least 20 degrees. In embodiments of the third aspect of the invention the linear rib may be angled relative to the longitudinal axis of rotation of the rotor by no more than 45 degrees, or no more than 40 degrees.

In embodiments of the first or second aspect of the invention the pump may further comprise a linear rib upstanding from either the rear surface of the resiliently deformable diaphragm or acting on the rear surface of the diaphragm; the linear rib being angled relative to the longitudinal axis of rotation of the rotor by at least 10 degrees, or at least 15 degrees, or at least 20 degrees. In embodiments of the first or second aspect of the invention the pump comprising a linear rib upstanding from either the rear surface of the resiliently deformable diaphragm or acting on the rear surface of the diaphragm, the linear rib is angled relative to the longitudinal axis of rotation of the rotor by no more than 45 degrees, or no more than 40 degrees.

In embodiments of the invention where the rotor is twisted, and the pump comprises a linear rib either protruding from or acting on the rear surface of the diaphragm which rib is angled relative to the longitudinal axis of the rotor, the rotor is twisted in the opposite direction to the angle of the rib.

In embodiments with a plurality of surface recesses and therefore a plurality of first openings between the first rotor cavity and the surface recess and a plurality of second openings between the second rotor cavity and the surface recess, a single first rotor cavity can simultaneously provide fluid to multiple fluid-conveying cavities through the plurality of first openings and the second rotor cavity can simultaneously receive fluid from the fluid-conveying cavities through the second openings.

Preferably, the pump according to all aspects of the invention the present invention comprises only a single rotor.

The combination of the first and second rotor cavities, first and second openings between the rotor cavities and the surface recess and the resiliently deformable diaphragms improves the consistency of the fluid flow rate provided and in some embodiments of all aspects of the invention, enables the pump to be arranged to provide a continuous flow rate. Different combinations of the number of diaphragms and the number of recesses on the rotor will produce different flow profiles of fluid through the pump.

A pump according to the first aspect of the invention comprising an even number of diaphragms and an odd number of fluid-conveying chambers will provide a continuous fluid flow. A pump according to the first aspect of the invention comprising an odd number of diaphragms and an even number of fluid-conveying chambers will provide a continuous fluid flow.

In a pump with a twisted rotor a fluid-conveying chamber is emptied over a larger rotation of the rotor which delivers a smoother flow profile. It is possible to overlap individual flow profile from each fluid-conveying chamber such that the combined flow output is continuous with less variation in flow rate.

In embodiments of all aspects of the invention with a plurality of diaphragms, the diaphragms are suitably equidistantly spaced about the circumference of the cavity in which the rotor is located. In embodiments of all aspects of the invention with a plurality of recesses on the rotor, the recesses are suitably equidistantly spaced about the circumference of the rotor.

In a preferred embodiment of all aspects of the invention, the pump comprises three diaphragms, which are located equidistantly about the circumference of the cavity in which the rotor is located, and the rotor has two surface recesses that form with said interior surface of the housing two fluid-conveying chambers that, on rotation of the rotor, conveys fluid from the first fluid port to the second fluid port.

If the rotor is twisted, the pump may comprise an equal number of resiliently deformable diaphragm and surface recesses on the rotor. In a preferred embodiment of a pump according to the second or third aspect of the invention, the pump comprises two surface recesses on the rotor and two resiliently deformable diaphragms.

In all aspects of the invention, all internal surfaces of the pump can be sterilised with a gas such as ethylene oxide or vapour hydrogen peroxide.

According to all aspects of the invention, the first fluid port and the second fluid port can be in various locations relative to each other, provided the first fluid port is in fluid flow communication with the first end of the rotor and the second fluid port is in fluid flow communication with the second end of the rotor. For example, both of the first and second fluid ports may be axially aligned relative to the longitudinal axis of rotation of the rotor, or both of the first and second fluid ports may be radially aligned relative to the longitudinal axis of rotation of the rotor, or one of the first and second fluid ports may be axially aligned relative to the longitudinal axis of rotation of the rotor and the other of the first and second fluid ports may be radially aligned relative to the longitudinal axis of rotation of the rotor.

In one embodiment of all aspects of the invention, the first fluid port and the second fluid port are at opposite ends of the rotor. In an alternative embodiment of all aspects of the invention, the first fluid port and the second fluid port may be located in the region of the same end of the rotor, provided the fluid flows from the second chamber through the diaphragm chamber to the second fluid outlet. In an alternative embodiment of all aspects of the invention, the first fluid port and the second fluid port are located in the region of opposite ends of the rotor.

When both the first fluid port and the second fluid part are radially aligned relative to the longitudinal axis of rotation of the rotor, the first fluid port and the second fluid port may be located on the same side of the rotor, alternatively, the first fluid port and the second fluid port may be circumferentially spaced apart around the circumference of the rotor.

In a preferred embodiment of all aspects of the invention, the direction of rotation of the rotor is reversible. In a first direction, the first fluid port is a fluid inlet port and the second fluid port is a fluid outlet port. In the opposite direction the first fluid port is the fluid outlet port and the second fluid port is the fluid inlet port.

When a pump according to all aspects of the present invention is in operation, fluid flows into the pump via the first fluid port, through the opening at the first end of the rotor and into the first rotor cavity. From the first rotor cavity, the fluid passes through the first opening between the first rotor cavity and the surface recess into the fluid-conveying chamber. The resiliently deformable diaphragms are urged onto the surface of the rotor by the pressurising means and displace the fluid from the fluid-conveying chamber through the second opening between the surface recess and the second rotor cavity and into the second rotor cavity.

From the second rotor cavity the fluid flows to the second fluid port.

The following is a more detailed description of embodiments of the invention, provided by way of example only, reference being made to the accompanying drawings, in which.

Figure 1:
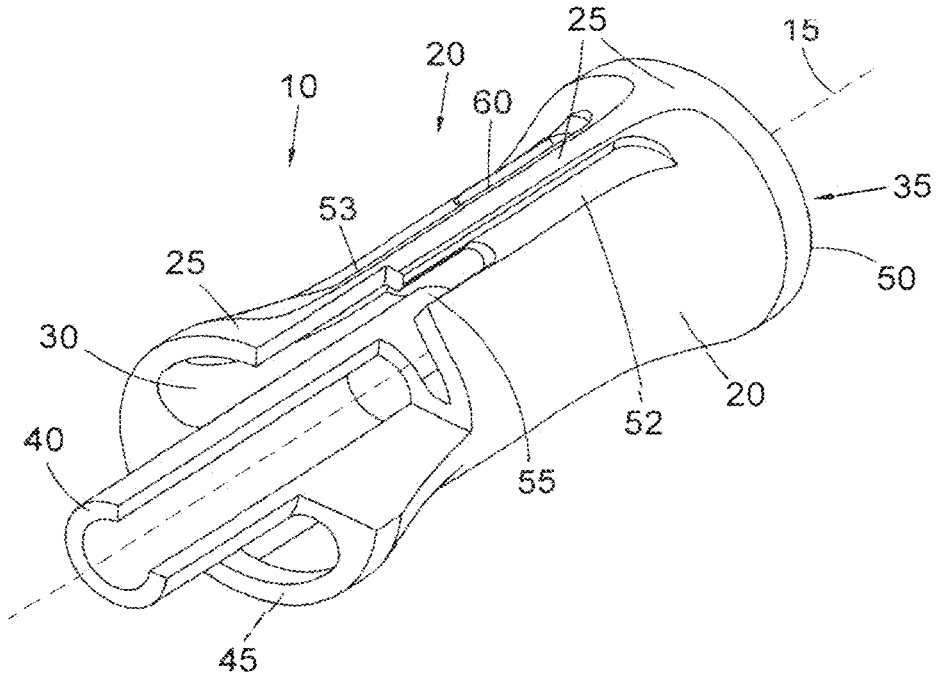
FIG. 1 is a schematic partially cut-away of a rotor according to an embodiment of the first or third aspects of the invention.

It can be seen from FIG. 1 that the rotor 10 has a generally cylindrical shape. Rotor 10 has two surface recesses 20, which extend along the longitudinal extent of the rotor 10, generally parallel to the longitudinal axis of rotation 15 of the rotor. The surface recesses 20 are provided by concave sections of the rotor. The rotor comprises a housing engaging surface area 25 at each end of the rotor and between adjacent surface recesses 20.

The rotor is hollow and comprises a first rotor cavity 30 and a second rotor cavity 35 arranged consecutively within the rotor 10. The rotor comprises a drive shaft 40 that extends within and is attached to the hollow interior of the rotor 10.

Each end 45, 50 of the rotor 10 is open to provide fluid access into the first and second fluid cavities 30, 35, respectively.

In the embodiment shown in FIG. 1, the rotor 10 further comprises a first groove 52 and a second groove 53 extending along opposing longitudinal edges of the surface recess 20.

Slots 55, 60 provide the opening between the first rotor cavity 30 and the surface recess 20 and the second rotor cavity 35 and the surface recess 20, respectively. Each slot 55, 60 is essentially linear and extends along a longitudinal edge of the recess 20 and is essentially parallel to the longitudinal axis of rotation of the rotor 15. However, slot 55 providing the first opening is located in the first groove 52 and the slot 60 providing the second opening is located in the second groove 53, the slots 55 and 60 are parallel but adjacent opposite sides of the land 25 extending between the recesses 20. For each of the two surface recesses 20 in the embodiment shown in FIG. 1, there is a slot 55 providing a first opening between the first rotor cavity 30 and the surface recess 20, and a slot 60 providing a second opening between the second rotor cavity 35 and the surface recess 20. The slots 55 and 60 are on opposite sides and opposite ends of the recess 20. The view shown in FIG. 1, shows only 30 one slot 55, 60 of each recess 20.

In the embodiment shown in FIG. 1, both of the slots 55 providing an opening between the first rotor cavity 30 and the surface recesses 20, to allow fluid to flow from the first rotor cavity 35 into the chamber formed by each surface recess 20. Likewise, both of slots 60 will allow fluid to flow from the chamber formed by each surface recess 20 into the second rotor cavity 35.

Figure 2:
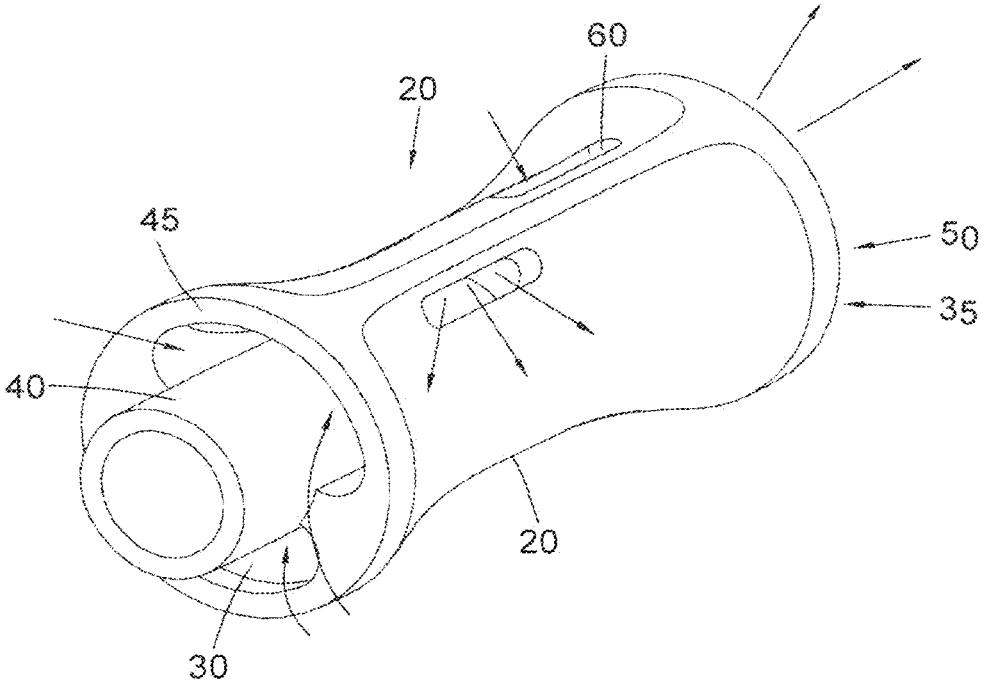
FIG. 2 is a rotor according to an embodiment of the first or third aspects of the invention showing the fluid flow.

FIG. 2 illustrates an alternative embodiment of the rotor of FIG. 1, without the grooves 52, 53 to locate the slots 55 and 60, but like features are referred to by like reference numerals. FIG. 2 also illustrates, for a given direction of rotation of the rotor, the direction of fluid flow into the first rotor cavity 30 through the openings in the end 45 of the rotor 10 and from the first rotor cavity out through the slot 55 into the chamber (not shown) formed by the surface recess 20. FIG. 2 also shows fluid from the adjacent chamber (not shown) formed by the adjacent surface recess 20 flowing into the slot 60 into the second rotor cavity 35 and out through the open end 50 of the rotor 10. This fluid flow will apply equally to the embodiment of FIG. 1 and FIG. 2.

Figure 3:
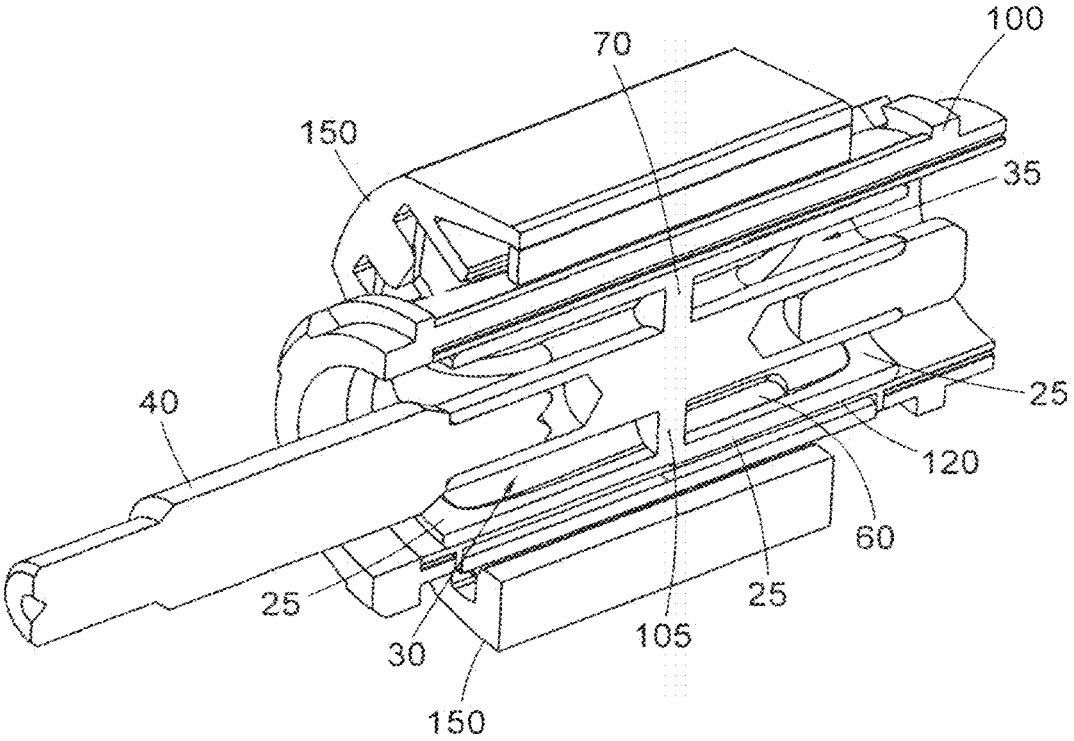
FIG. 3 is a schematic cross-sectional view through part of a pump comprising the rotor of FIGS. 1 and 2.

FIG. 3 shows a rotor 105 similar to the rotor 10 of FIGS. 1 and 2 in a housing 100. The cross-sectional view of FIG. 3 shows the arrangement of the first rotor cavity 30 and the second rotor cavity 35 more clearly. It also shows the bulkhead 70 which separates the first and second rotor cavities 30, 35. FIG. 3 also illustrates more clearly how the drive shaft 40, which is attached to or unitary with the rotor, extends from the interior of hollow the rotor 10. Only one slot 60 is shown in this view, which is the opening between the second rotor cavity 35 and the surface recess (not shown). This view illustrates the housing engaging surface area 25 at each end of the rotor and between adjacent surface recesses. (not shown).

FIG. 3 further illustrates parts of two diaphragm chambers 150 each surrounding the rear surface of a diaphragm 120. The diaphragm being urged into contact with the rotor 10 by pressurising means (not shown).

Figure 4:
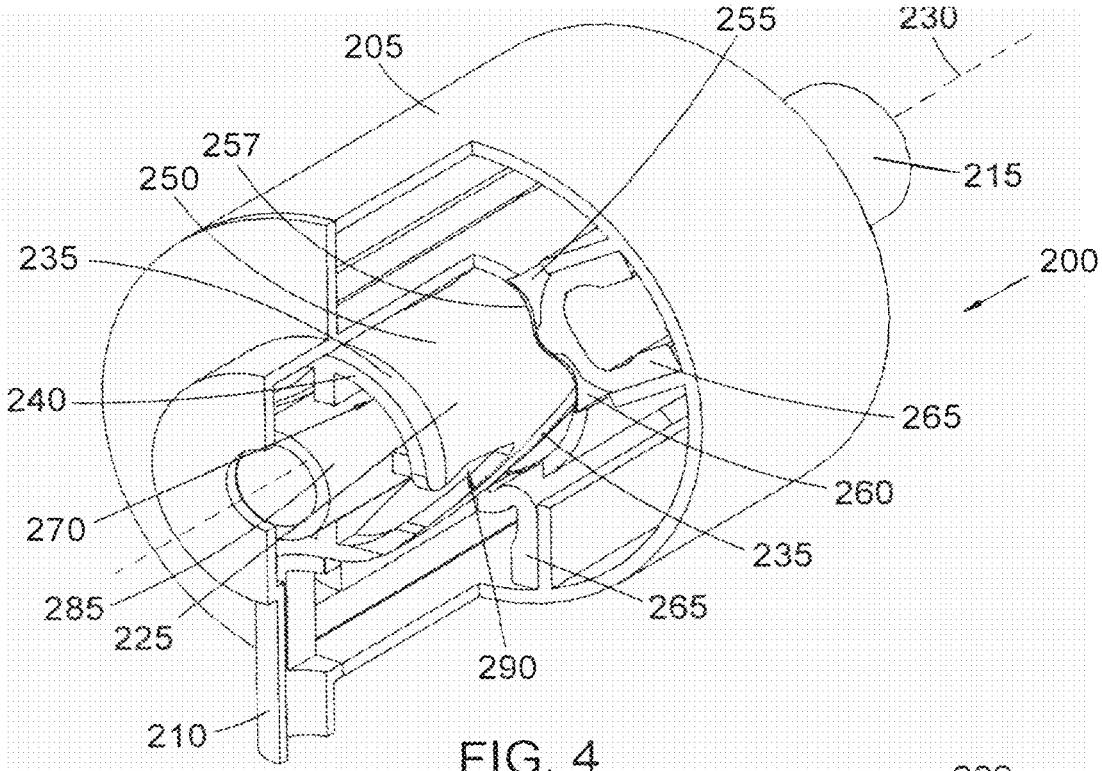
FIG. 4 is a schematic, partially cutaway view of a pump according to a second embodiment of first or third aspects of the invention.
Figure 5:
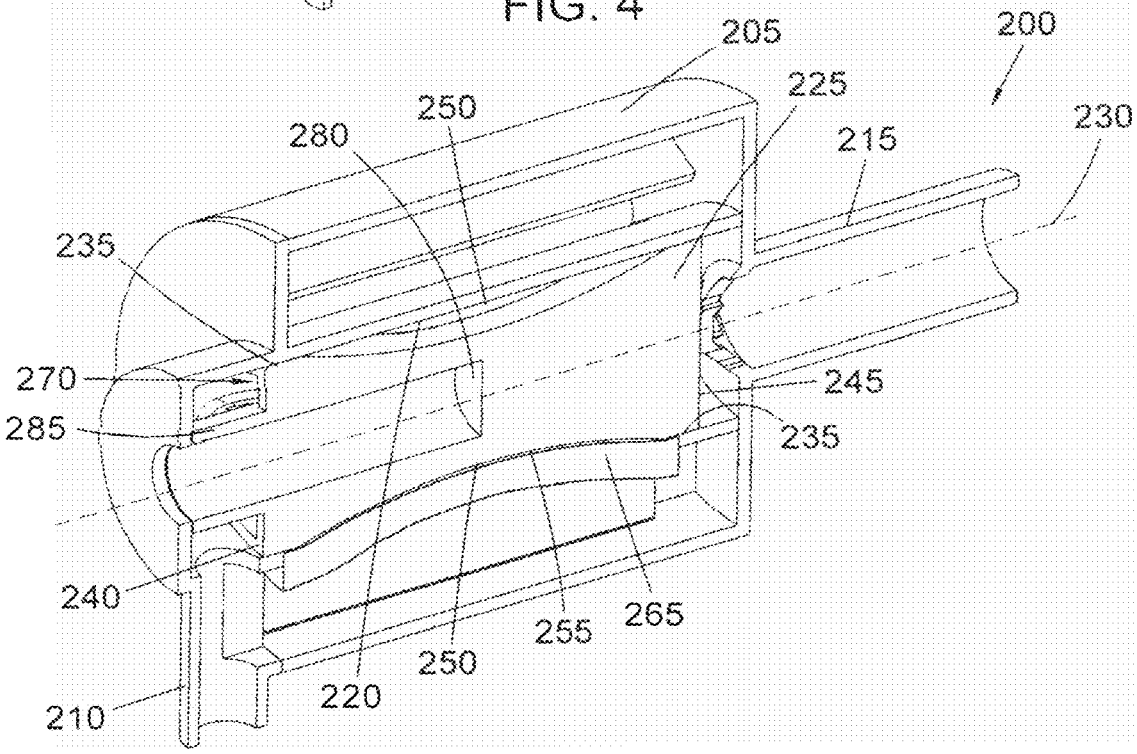
FIG. 5 is a cross-sectional view of the pump of FIG. 4.

FIGS. 4 and 5 show a pump 200 having a housing 205, a first fluid port 210 providing a fluid inlet and a second fluid port 215 providing a fluid outlet. The housing having an interior surface 220 defining a cavity in which the rotor 225 is located. The rotor 225 has a longitudinal axis of rotation indicated by dashed line 230. The rotor 225 having surfaces 235 at each end thereof and the lands extending between recesses on the surface thereof together providing a housing engaging surface area of the rotor. The rotor shown in FIGS. 4 and 5 is twisted about the longitudinal axis of rotation 230, such that the first end 240 and the second end 245 are offset relative to one another. The rotor 225 has two surface recesses 250 provided by concave areas of the rotor surface. A resiliently deformable diaphragm 255 is formed by a thinner section of the housing providing the cavity in which the rotor 225 is located. The resiliently deformable diaphragm 255 has a rotor engaging surface 257 and a rear surface 260. Pressurising means in the form of a spring 265 is in contact with the rear surface 260 of the diaphragm 255. It can be seen from FIGS. 4 and 5 that the rotor 225 comprises an elongate body that is substantially hollow, comprising a first rotor cavity 270 and a second rotor cavity (not shown). The first rotor cavity 270 has openings at the first end 240 of the rotor and the second rotor cavity (not shown) has openings (not shown) at the second end 245 of the rotor. The first rotor cavity 270 and the second rotor cavity (not shown) are separated from each other by a bulkhead 280 that extends across the full interior of the hollow rotor, to prevent fluid flowing along the full internal length of the rotor. The drive shaft 285 extends from the bulkhead 280. The rotor comprises a first opening 290 extending between the first rotor cavity 270 and the surface recess 250 of the rotor. It can be seen from FIG. 4 that the first opening 290 has a tapered shape and extends along a longitudinal edge of a section of the surface recess 250 overlying the first rotor cavity 270 and continues across the land 235 at the first end 240 of the rotor, making an opening in the housing engaging surface provided by the land 235 at the first end 240 of the rotor. The rotor also comprises a similarly arranged second opening (not shown) extending between the second rotor cavity (not shown) and the surface recess 250. The second opening will by locating on the opposite longitudinal edge of the recess 250 and at the opposite end of the rotor 225, such that it overlies the second rotor cavity (not shown). It can be seen from FIG. 4, in particular, that the pressurising means 265 urges the resiliently deformable diaphragm 255 into contact with the surface recess 250 and is located such that the contact line between the diaphragm 255 and the surface recess 250 bisects the first opening 290 and the second opening (not shown) because the second opening (not shown) is located on the opposite longitudinal edge of the recess 250.

There are three resiliently deformable diaphragm 255 (not all shown) equidistantly spaced about the circumference of the rotor and a spring 265 providing pressurising means acts on the rear surface of each diaphragm.

Each of the two surface recesses 250 has a first opening 290 and a second opening at opposite ends of the rotor and extending along opposite longitudinal edges of each recess 250.

In use of the pump 200, the rotor 225 is rotated by the action of a motor connected to the drive shaft 285, fluid flows into the first fluid port 210 and then into the first rotor cavity 270 through the open first end 245 of the rotor 225. The fluid flows from the first rotor cavity 270 through each first opening 290 into the fluid-conveying cavity provided between the surface recesses 250 and the interior surface 220 of the housing. The resiliently deformable diaphragm 255 is urged into contact with the surface of the rotor as it rotates by the action of the spring 265. The action of the diaphragm 255 on the surface of the rotor 225 displaces the fluid from the fluid-conveying cavity as the rotor rotates and the fluid flows through the second openings into the second rotor cavity (not shown). From there, the fluid flows out of the pump though the second fluid port 215.

Figure 6:
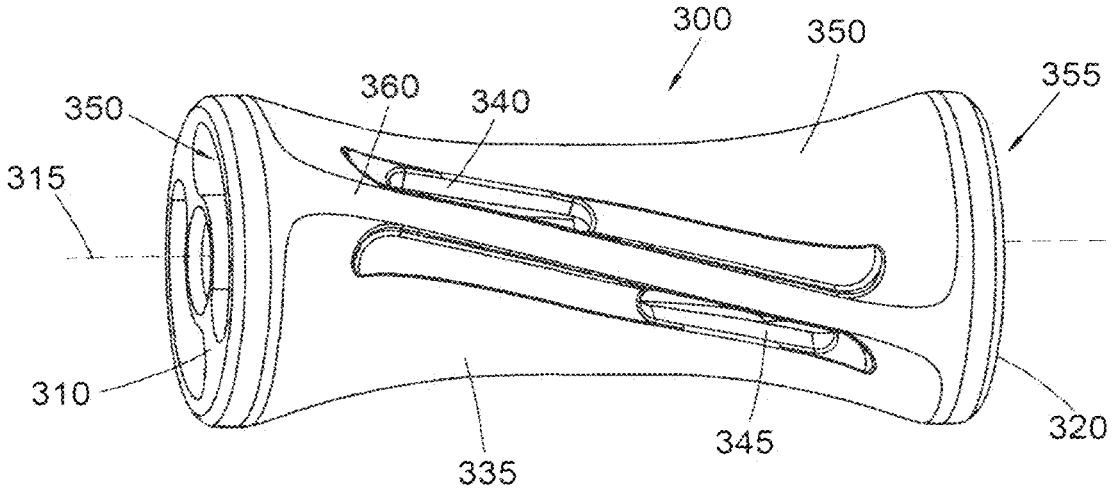
FIG. 6 is a schematic view of a rotor according to an embodiment of the second aspect of the invention.

FIG. 6 shows an alternative rotor 300. The rotor is twisted about the longitudinal axis of rotation 315 of the rotor 300, such that opposing ends 310,320 of the rotor are off-set relative to one another.

It can be seen that the result of twisting the rotor is to distort the shape oft he surface recesses 330, 335. Since the first slot 340 providing the opening between the first rotor cavity 350 and the surface recess 330 and the second slot 345 providing the opening between the second rotor cavity 355 and the surface recess 335 extend along opposing edges of the recesses 330, 335, the twisting of the rotor also causes the slots 340, 345 to become angled relative to the longitudinal axis of rotation 315 of the rotor 300. FIG. 4 also illustrates that twisting the rotor also angles the land 360 between adjacent recesses 330, 335, which becomes angled relative to the longitudinal axis of rotation 315 of the rotor 300.

Figure 7:
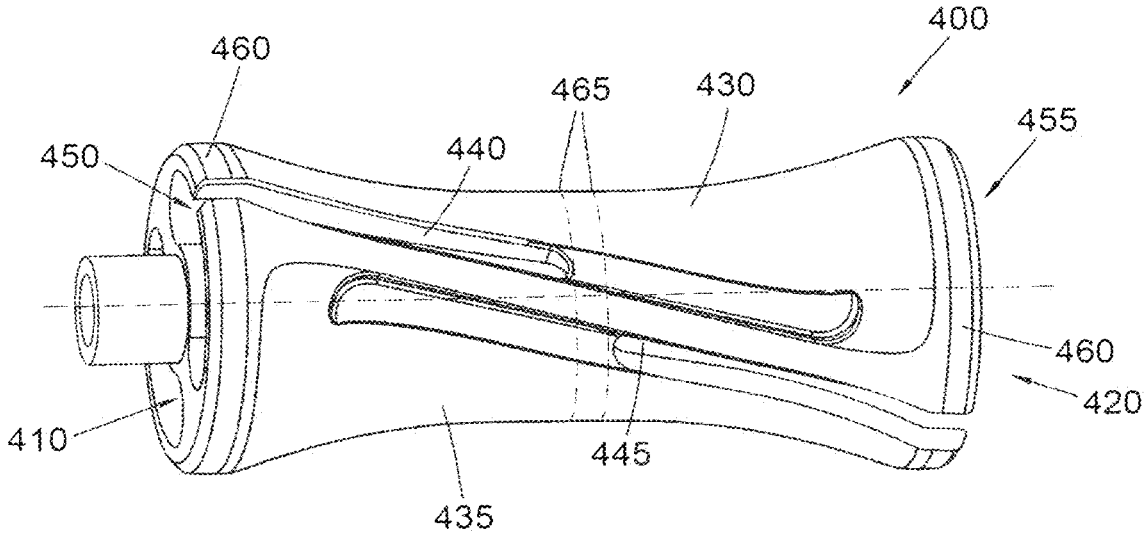
FIG. 7 is a schematic illustration of a rotor according to a second embodiment of the second aspect of the invention.

FIG. 7 shows a rotor 400 which is a variation of the rotor 300 of FIG. 5. In this embodiment, the first slot 440 providing the opening between the first rotor cavity 450 and the surface recess 430 and continues through the first end 410 of the rotor. The second slot 445 providing the opening between the second rotor cavity 455 and the surface recess 435, continues through the second end 420 of the rotor. It can be seen that the first slot 440 and the second slot 445 extend through housing engaging surface area 460 at each end of the rotor.

The dashed lines 465 illustrate the location of the bulkhead extending across the interior of the rotor 400, separating the first rotor cavity 450 and the second rotor cavity 455.

This arrangement of the first and second slots is not limited to a twisted rotor as illustrated in FIGS. 4 and 7. In the rotor of FIGS. 1 and 2 the slots 55, 60 could also extend through the first and second ends 45 50, respectively and through the surface engaging surface area 25.

Figure 8:
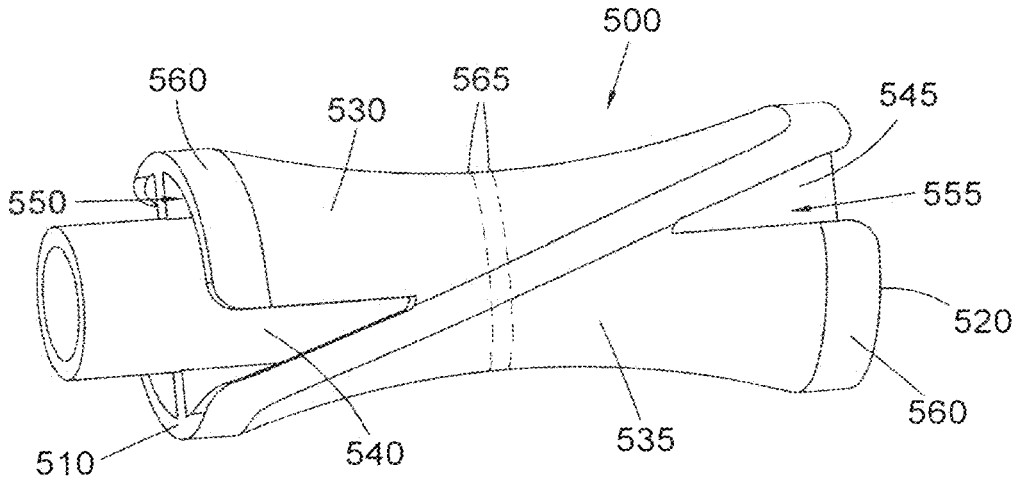
FIG. 8 is a schematic illustration or a rotor according to a third embodiment of the second aspect of the invention.

FIG. 8 shows a rotor 500 which is a variation of the rotor 400 of FIG. 6. In this embodiment, the first slot 540 providing the opening between the first rotor cavity 550 and the surface recess 530. The slot is open at the first end 510 of the rotor. The second slot 545 providing the opening between the second rotor cavity 555 and the surface recess 535.

The slot is open at the second end 520 of the rotor. It can be seen that the first slot 540 and the second slot 545 extend through housing engaging surface area 560 at each end of the rotor. In the embodiment of FIG. 8 the first slot 540 and the second slot 545 are tapered with the widest part forming the opening in the first end 510 and the second end 520 of the rotor respectively.

The dashed lines 565 illustrate the location of the bulkhead extending across the interior of the rotor 500, separating the first rotor cavity 550 and the second rotor cavity 555.

This arrangement of the first and second slots is not limited to a twisted rotor. In the rotor of FIGS. 1 and 2 the slots 55, 60 could also be tapered and extend through the first and second ends 45 50, respectively and through the surface engaging surface area 25.

Figure 9:
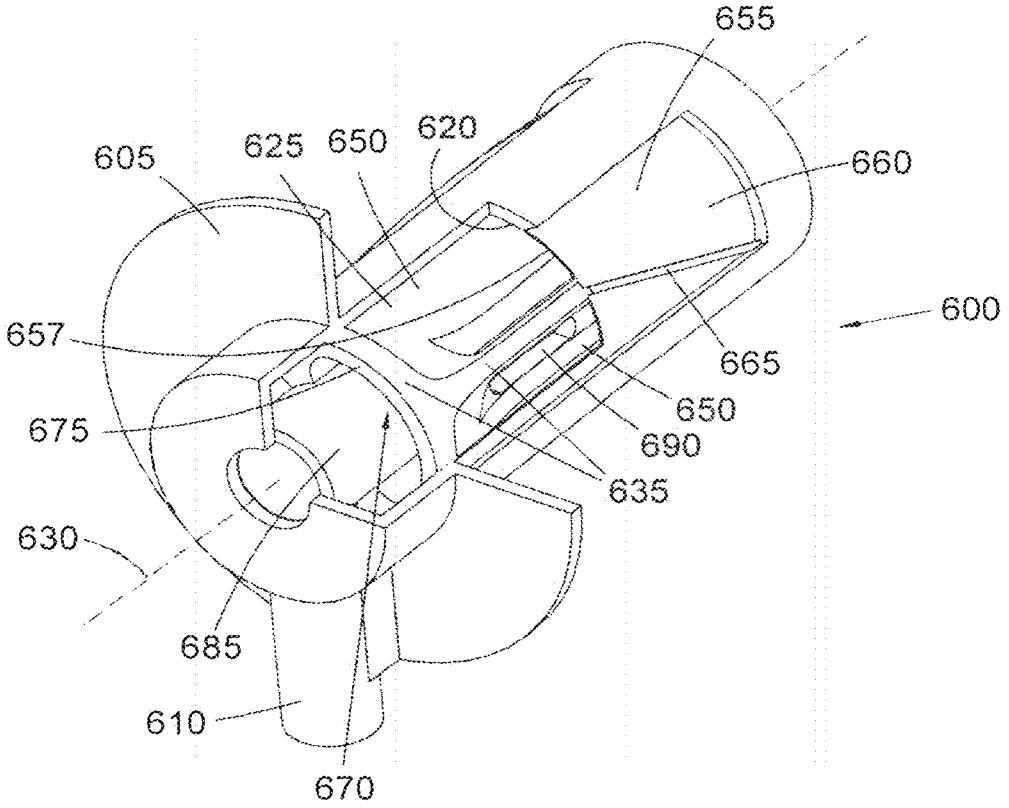
FIG. 9 is a schematic, partially cut-away illustration of part of a pump according to an embodiment of the third aspect of the invention.

FIG. 9 shows part of a pump 600 having a housing 605, a first fluid port 610 providing a fluid inlet and a second fluid port (not shown) providing a fluid outlet. The housing having an interior surface 620 defining a cavity in which the rotor 625 is located. The rotor 625 has a longitudinal axis of rotation indicated by dashed line 630. The rotor 625 having lands 635 at each end thereof and between recesses on the surface thereof together providing a housing engaging surface area of the rotor. The rotor 625 has two surface recesses 650 provided by concave areas of the rotor surface. A resiliently deformable diaphragm 655 is formed by a thinner section of the housing providing the cavity in which the rotor 625 is located. The resiliently deformable diaphragm 655 has a rotor engaging surface 657 and a rear surface 660. The resiliently deformable diaphragm 655 has a linear rib 665 protruding from the rear surface 660 of the diaphragm 655. The linear rib 665 is angled relative to the longitudinal axis of rotation 630 of the rotor. It can be seen from FIG. 9 that the rotor 625 comprises an elongate body that is substantially hollow, comprising a first rotor cavity 670 and a second rotor cavity (not shown) at the opposite end of the rotor 625. The first rotor cavity 670 has openings at a first end 675 of the rotor and the second rotor cavity (not shown) has openings (not shown) at a second end of the rotor (not shown). The first rotor cavity 670 and the second rotor cavity (not shown) are separated from each other by a bulkhead (not shown) that extends across the full interior of the hollow rotor, to prevent fluid flowing along the full internal length of the rotor. The rotor 625 comprises a first opening 690 extending between the first rotor cavity 670 and the surface recess 650 of the rotor. The first opening 690 has a linear shape and extends along a longitudinal edge of a section of the surface recess 650 overlying the first rotor cavity 670. The rotor also comprises a similarly arranged second opening (not shown) extending between the second rotor cavity (not shown) and the surface recess 650. The second opening is located on the opposite longitudinal edge of the recess 650 and at the opposite end of the rotor 625, such that it overlies the second rotor cavity (not shown). Each surface recess 650 has a first opening 690 and a second opening arranged at opposite ends of the rotor and on opposite sides of the recess.

In use of the pump 600, the rotor 625 is rotated by the action of a motor connected to the drive shaft 685, fluid flows into the first fluid port 610 and then into the first rotor cavity 670 through the open first end 675 of the rotor 625. The fluid flows from the first rotor cavity 670 through each first opening 690 into the fluid-conveying cavity provided between the surface recesses 650 and the interior surface 620 of the housing. The resiliently deformable diaphragm 655 is urged into contact with the surface of the rotor as it rotates by the action of pressurising means (not shown). The action of the diaphragm 655 on the surface of the rotor 625 displaces the fluid from the fluid-conveying cavity as the rotor rotates and the fluid flows through the second openings (not shown) into the second rotor cavity (not shown). From there, the fluid flows out of the pump though the second fluid port (not shown).

Figure 10:
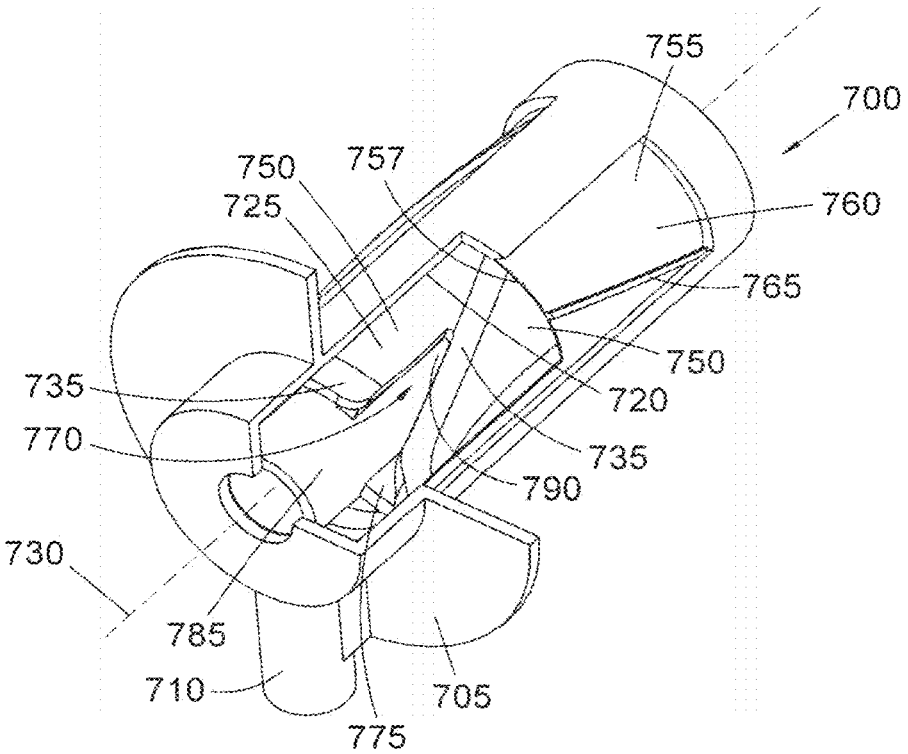
FIG. 10 is a schematic, partially cut-away illustration of part of a pump according to an alternative embodiment of the third aspect of the invention.

FIG. 10 shows part of a pump 700 having a housing 705, a first fluid port 710 providing a fluid inlet and a second fluid port (not shown) providing a fluid outlet. The housing having an interior surface 720 defining a cavity in which the rotor 725 is located. The rotor 725 has a longitudinal axis of rotation indicated by dashed line 730. The rotor 725 having lands 735 at each end thereof and between recesses on the surface thereof together providing a housing engaging surface area of the rotor. The rotor 725 has two surface recesses 750 provided by concave areas of the rotor surface. A resiliently deformable diaphragm 755 is formed by a thinner section of the housing providing the cavity in which the rotor 725 is located. The resiliently deformable diaphragm 755 has a rotor engaging surface 757 and a rear surface 760. The resiliently deformable diaphragm 755 has a linear rib 765 protruding from the rear surface 760 of the diaphragm 755. The linear rib 765 is angled relative to the longitudinal axis of rotation 730 of the rotor. It can be seen from FIG. 10 that the rotor 725 comprises an elongate body that is substantially hollow, comprising a first rotor cavity 770 and a second rotor cavity (not shown) at the opposite end of the rotor 725. The rotor 725 is twisted about the longitudinal axis of rotation 730, such that opposite ends of the rotor 725 are offset relative to one another. The rotor 725 is twisted in the opposite direction to the direction that the rib 765 is angled relative to the longitudinal axis of rotation 730 of the rotor. The first rotor cavity 770 has openings at a first end 775 of the rotor and the second rotor cavity (not shown) has openings (not shown) at a second end of the rotor (not shown). The first rotor cavity 770 and the second rotor cavity (not shown) are separated from each other by a bulkhead (not shown) that extends across the full interior of the hollow rotor, to prevent fluid flowing along the full internal length of the rotor. The rotor 725 comprises a first opening 790 extending between the first rotor cavity 770 and the surface recess 750 of the rotor. The first opening 790 has a has a tapered shape and extends along a longitudinal edge of a section of the surface recess 750 overlying the first rotor cavity 770 and continues across the land 735 at the first end 775 of the rotor, making an opening in the housing engaging surface provided by the land 735 at the first end 775 of the rotor. The rotor also comprises a similarly arranged second opening (not shown) extending between the second rotor cavity (not shown) and the surface recess 750. The second opening is located on the opposite longitudinal edge of the recess 750 and at the opposite end of the rotor 725, such that it overlies the second rotor cavity (not shown). Each surface recess 750 has a first opening and a second opening arranged at opposite ends of the rotor and on opposite sides of the recess.

In use of the pump 700, the rotor 725 is rotated by the action of a motor connected to the drive shaft 785, fluid flows into the first fluid port 710 and then into the first rotor cavity 770 through the open first end 775 of the rotor 725. The fluid flows from the first rotor cavity 770 through each first opening 790 into the fluid-conveying cavity provided between the surface recesses 750 and the interior surface 720 of the housing. The resiliently deformable diaphragm 755 is urged into contact with the surface of the rotor as it rotates by the action of pressurising means (not shown). The action of the diaphragm 755 on the surface of the rotor 725 displaces the fluid from the fluid-conveying cavity as the rotor rotates and the fluid flows through the second openings into the second rotor cavity (not shown). From there, the fluid flows out of the pump though the second fluid port (not shown).

Figure 11:
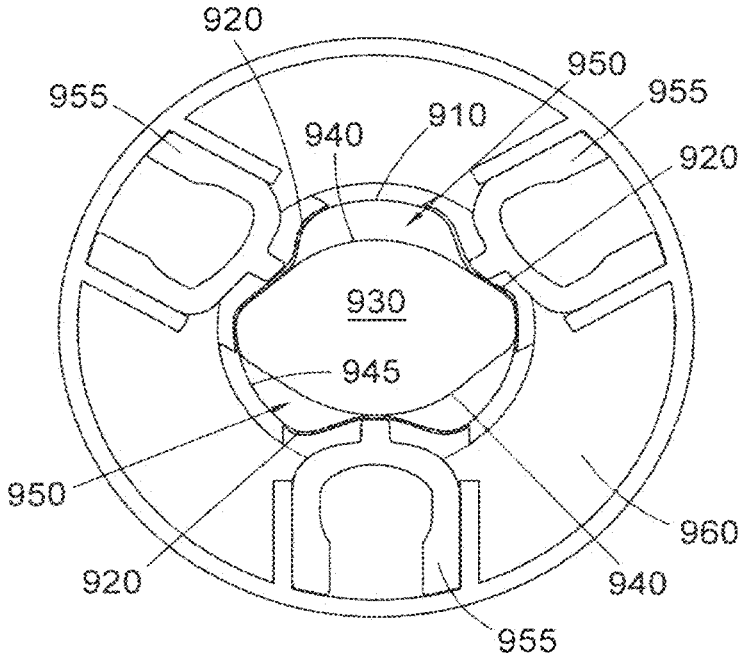
FIG. 11 is a schematic cross-sectional view of a pump according to an embodiment of the first aspect of the invention.

FIG. 11 illustrates a cross-sectional view though part of a pump according to an embodiment of this invention. This figure illustrates the action of a plurality of diaphragm on the surface of a rotor comprising a plurality of recesses. In particular, FIG. 11 shows a housing 910 comprising three resiliently deformable diaphragm 920 each formed as a unit with the housing as provided by a thinner section of the housing. The section of housing providing the diaphragms being sufficiently thin to make the diaphragms resiliently deformable. The three diaphragms 920 are equidistantly spaced about the circumference of the rotor 930.

The rotor 930 comprises two surface recesses 940, which form, with the interior surface 945 of the housing, two fluid-conveying chambers 950.

Each diaphragm 920 is urged into contact with the surface of the rotor 930 by spring means 955 located within a diaphragm chamber 960. The spring means 955 ensure that each resiliently deformable diaphragm 920 remains in contact with the surface of the rotor 930 as it rotates and the surface profile of the rotor 930 varies. As can be seen from FIG. 11, each spring means 955 comprises a rib acting on the rear surface of the diaphragm 920.

Figure 12:
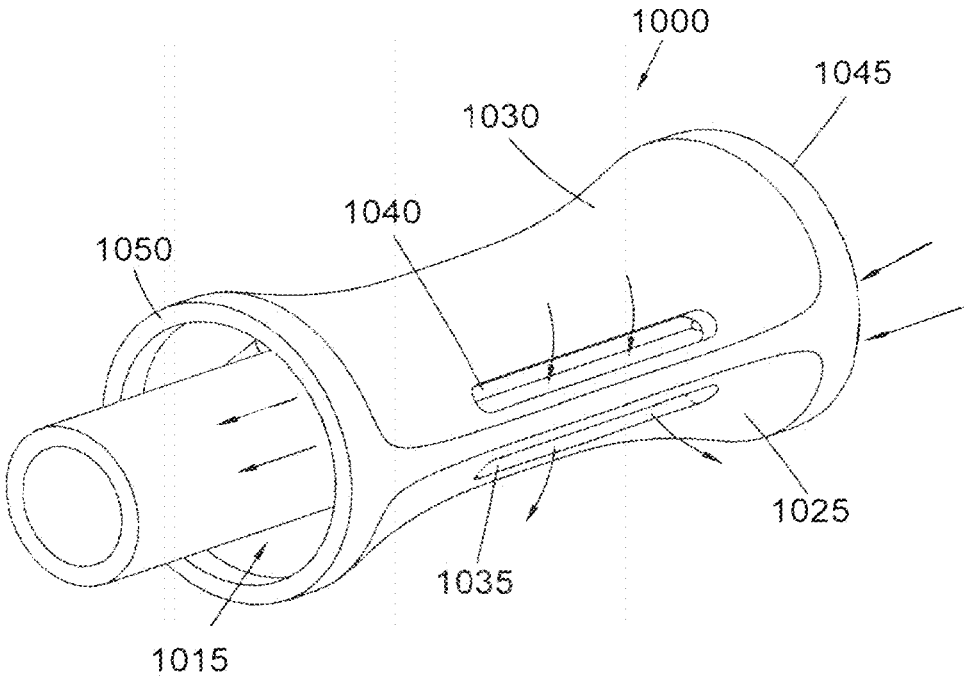
FIG. 12 is a schematic view of a rotor according to an alternative embodiment of the first or third aspects of the invention.
Figure 13:
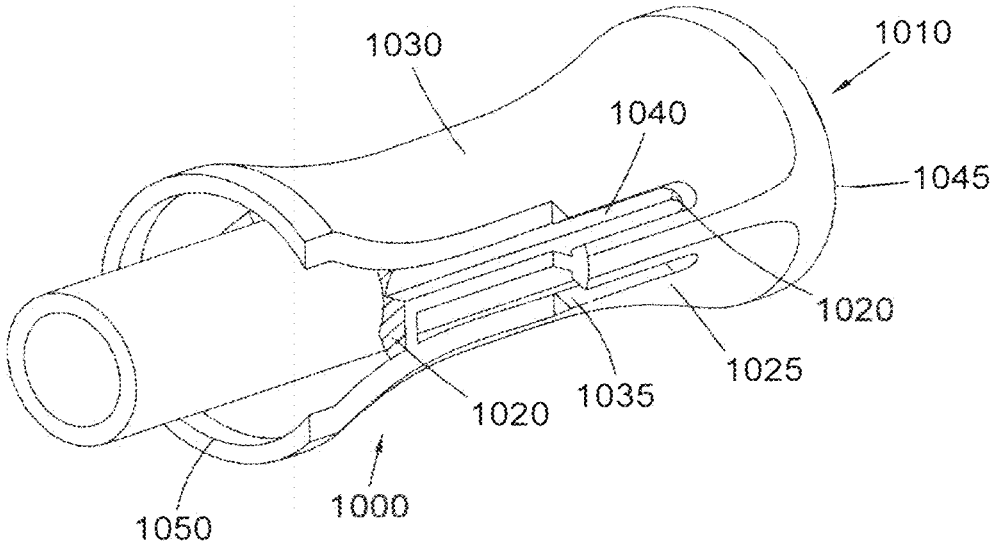
FIG. 13 is a schematic, partially cut-away view of the rotor of FIG. 12.

FIGS. 12 and 13 illustrate an example of a rotor 1000, comprising an elongate body, which body is substantially hollow and comprises a first rotor cavity 1010 and second rotor cavity 1015. The first and second rotor cavities extend longitudinally along the length of the rotor and extend at least partially alongside one another. The first rotor cavity 1010 and the second rotor cavity 1015 are separated from each other by a bulkhead 1020. The bulkhead is staggered and separates the first and second rotor cavities 1010, 1015 such that the first rotor cavity 1010 and the second rotor cavity 1015 are not in direct fluid communication. The rotor further comprises two recesses 1025 and 1030. Each recess comprises a first opening 1035 between the first rotor cavity 1010 and the recess 1025, 1030 and a second opening 1040 between the recesses 1025 and 1030 and the second rotor cavity 1015. In FIGS. 13 and 14 only the second opening 1040 of recess 1030 is illustrated and only first opening 1035 of recess 1025 is illustrated. The first openings 1035 and the second openings 1040 in the rotor 1000 extend along a major portion of opposing longitudinal edges of each recess 1025, 1030. However, the arrangement of the first and second openings 1035, 1040 and the bulkhead 1020 are such that the first openings 1035 only open into first rotor cavity 1010 and the second openings 1040 only open into the second rotor cavity 1015. It can further be seen from FIGS. 12 and 13 that the first rotor cavity is open at only a first end 1045 of the rotor and the second rotor cavity 1015 is open only at a second end 1050 of the rotor.

The arrows indicate the direction of fluid flow, in one direction of rotation, when the rotor 1000 is in use in a pump according to any aspect of the present invention. It can be seen from FIG. 13 that fluid flow into the first rotor cavity 1010 through the end first end 1045, from there fluid flows through the first openings 1035 into the recesses 1025, 1030. As the pump operates and the rotor rotates in the given direction the fluid in the recesses 1025, 1030 is displaced by the pressurising means (not shown) through the second openings 1040 and into the second rotor cavity 1015 and out through the open second end 1050 of the rotor 1000. If the direction of rotation of the rotor is reversed, the direction of fluid flow will be reversed.

The invention claimed is:

1. A pump comprising:

a housing having an interior surface, the housing comprising a first fluid port and a second fluid port; and a rotor installed in the housing, the rotor comprising:

a housing engaging surface area forming a sealing interference fit with the interior surface of the housing;

a surface recess that forms a fluid-conveying chamber with the interior surface of the housing that, on rotation of the rotor within the housing, conveys fluid from the first fluid port to the second fluid port;

a first fluid passageway extending partially through the surface recess and having a first opening at a first end of the rotor, the first opening being in fluidic communication with the first fluid port of the housing; and a second fluid passageway extending partially through the surface recess and having a second opening at a second, opposite, end of the rotor, the second opening being in fluidic communication with the second fluid port of the housing, wherein the first opening between the first fluid passageway and the surface recess is located adjacent and contiguous with an edge of the surface recess that forms a leading edge as the rotor rotates, and the second opening between the surface recess and the second fluid passageway is located adjacent and contiguous with an opposite edge of the surface recess that forms a following edge as the rotor rotates.

2. The pump according to claim 1, wherein the rotor is twisted about a longitudinal axis of rotation, such that the first end and the second end of the rotor are rotationally offset relative to one another by at least 10 degrees.

3. The pump according to claim 1, further comprising a plurality of resiliently deformable diaphragms providing part of the interior surface of the housing, each resiliently deformable diaphragm comprising a rotor engaging surface and a rear surface opposite the rotor engaging surface, wherein the rotor engaging surface of each resiliently deformable diaphragm is urged into contact with the rotor by a spring force acting on the rear surface of the resiliently deformable diaphragm.

4. The pump according to claim 3, wherein a number of resiliently deformable diaphragms exceeds a number of surface recesses on the rotor.

5. The pump according to claim 3, wherein the spring force is applied by at least one of: a spring, a resilient member, or a fluid acting on the rear surface of each of the resiliently deformable diaphragms.

6. The pump according to claim 3, wherein one or each resiliently deformable diaphragm comprises a linear rib extending longitudinally along a length of the rear surface of the resiliently deformable diaphragm.

7. The pump according to claim 1, wherein the rotor comprises a substantially cylindrical body in which the surface recess is formed, and the housing engaging surface area comprises the whole cylindrical body of the rotor except the surface recess.

8. A pump comprising:

a housing having an interior surface, the housing comprising a first fluid port and a second fluid port;

a rotor installed in the housing, the rotor comprising:

a housing engaging surface area forming a sealing interference fit with the interior surface of the housing;

a surface recess that forms a fluid-conveying chamber with the interior surface of the housing that, on rotation of the rotor within the housing, conveys fluid from the first fluid port to the second fluid port;

a first fluid passageway extending partially through the surface recess and having a first opening at a first end of the rotor, the first opening being in fluidic communication with the first fluid port of the housing; and a second fluid passageway extending partially through the surface recess and having a second opening at a second, opposite, end of the rotor, the second opening being in fluidic communication with the second fluid port of the housing; and a plurality of resiliently deformable diaphragms providing part of the interior surface of the housing, each resiliently deformable diaphragm comprising a rotor engaging surface and a rear surface opposite the rotor engaging surface, wherein the rotor engaging surface of each resiliently deformable diaphragm is urged into contact with the rotor by a spring force acting on the rear surface of the resiliently deformable diaphragm, wherein one or each resiliently deformable diaphragm comprises a linear rib extending longitudinally along a length of the rear surface of the resiliently deformable diaphragm, and wherein the linear rib is angled relative to a longitudinal axis of rotation of the rotor by at least 10 degrees.

9. The pump according to claim 8, wherein the first opening between the first fluid passageway and the surface recess is located adjacent and contiguous with an edge of the surface recess that forms a leading edge as the rotor rotates, and the second opening between the surface recess and the second fluid passageway is located adjacent and contiguous with an opposite edge of the surface recess that forms a following edge as the rotor rotates.

10. A pump comprising:

a housing having an interior surface, the housing comprising a first fluid port and a second fluid port; and a rotor installed in the housing, the rotor comprising:

a housing engaging surface area forming a sealing interference fit with the interior surface of the housing;

a surface recess that forms a fluid-conveying chamber with the interior surface of the housing that, on rotation of the rotor within the housing, conveys fluid from the first fluid port to the second fluid port;

a first fluid passageway extending partially through the surface recess and having a first opening at a first end of the rotor, the first opening being in fluidic communication with the first fluid port of the housing; and a second fluid passageway extending partially through the surface recess and having a second opening at a second, opposite, end of the rotor, the second opening being in fluidic communication with the second fluid port of the housing, wherein the first opening between the first fluid passageway and the surface recess extends along substantially a full axial length of the surface recess that overlies the first fluid passageway, and the second opening between the surface recess and the second fluid passageway extends along substantially a full axial length of the surface recess that overlies the second fluid passageway.

11. A pump comprising:

a housing having an interior surface, the housing comprising a first fluid port and a second fluid port; and a rotor installed within the housing and having a longitudinal axis of rotation, the rotor comprising:

a housing engaging surface area forming a sealing interference fit with the interior surface of the housing;

a first fluid passageway having a first opening at a first end of the rotor, the first opening being in fluidic communication with the first fluid port of the housing;

a second fluid passageway having a second opening at a second end, opposite, end of the rotor, the second opening being in fluidic communication with the second fluid port of the housing; and a plurality of surface recesses, each forming a fluid-conveying chamber with the interior surface of the housing that, on rotation of the rotor within the housing, conveys fluid from the first fluid port to the second fluid port, wherein the first fluid passageway extends partially through each surface recess, and the second fluid passageway extends partially through each surface recess, wherein the rotor is twisted about the longitudinal axis of rotation, such that the first end and the second end of the rotor are rotationally offset relative to one another by at least 15 degrees and no more than 20 degrees.

12. The pump according to claim 11, further comprising a plurality of resiliently deformable diaphragms providing part of the interior surface of the housing, each resiliently deformable diaphragm comprising a rotor engaging surface and a rear surface opposite the rotor engaging surface, wherein the rotor engaging surface of each resiliently deformable diaphragm is urged into contact with the rotor by a spring force acting on the rear surface of the resiliently deformable diaphragm.

13. The pump according to claim 12, wherein a number of resiliently deformable diaphragms exceeds a number of surface recesses on the rotor.

14. The pump according to claim 12, wherein the spring force is applied by a common spring force acting on the rear surface of all of the resiliently deformable diaphragms.

15. The pump according to claim 12, wherein the spring force is applied by a fluid acting on the rear surface of each of the resiliently deformable diaphragms, and wherein the fluid is a pumped fluid.

16. The pump according to claim 11, wherein the housing comprises three resiliently deformable diaphragms and the rotor comprises two surface recesses forming two fluid-conveying chambers with the interior surface of the housing.

17. A pump comprising:

a housing having an interior surface, the housing comprising a first fluid port and a second fluid port;

a rotor installed within the housing and having a longitudinal axis of rotation, the rotor comprising:

a housing engaging surface area forming a sealing interference fit with the interior surface of the housing;

a first fluid passageway having a first opening at a first end of the rotor, the first opening being in fluidic communication with the first fluid port of the housing;

a second fluid passageway having a second opening at a second end, opposite, end of the rotor, the second opening being in fluidic communication with the second fluid port of the housing; and a plurality of surface recesses, each forming a fluid-conveying chamber with the interior surface of the housing that, on rotation of the rotor within the housing, conveys fluid from the first fluid port to the second fluid port, wherein the first fluid passageway extends partially through each surface recess, and the second fluid passageway extends partially through each surface recess; and a plurality of resiliently deformable diaphragms providing part of the interior surface of the housing, each resiliently deformable diaphragm comprising a rotor engaging surface and a rear surface opposite the rotor engaging surface, wherein the rotor engaging surface of each resiliently deformable diaphragm is urged into contact with the rotor by a spring force acting on the rear surface of the resiliently deformable diaphragm, wherein one or each resiliently deformable diaphragm comprises a linear rib extending longitudinally along a length of the rear surface of the resiliently deformable diaphragm, the linear rib being angled relative to the longitudinal axis of rotation of the rotor by at least 15 degrees.

18. A pump comprising:

a housing having an interior surface, the housing comprising a first fluid port and a second fluid port;

a rotor installed within the housing and having a longitudinal axis of rotation, the rotor comprising:

a housing engaging surface area forming a sealing interference fit with the interior surface of the housing;

a first fluid passageway having a first opening at a first end of the rotor, the first opening being in fluidic communication with the first fluid port of the housing;

a second fluid passageway having a second opening at a second end, opposite, end of the rotor, the second opening being in fluidic communication with the second fluid port of the housing; and a plurality of surface recesses, each forming a fluid-conveying chamber with the interior surface of the housing that, on rotation of the rotor within the housing, conveys fluid from the first fluid port to the second fluid port, wherein the first fluid passageway extends partially through each surface recess, and the second fluid passageway extends partially through each surface recess; and a plurality of resiliently deformable diaphragms providing part of the interior surface of the housing, each resiliently deformable diaphragm comprising a rotor engaging surface and a rear surface opposite the rotor engaging surface, wherein the rotor engaging surface of each resiliently deformable diaphragm is urged into contact with the rotor by a spring force acting on the rear surface of the resiliently deformable diaphragm, wherein for each surface recess, the first opening between the first fluid passageway and the surface recess and the second opening between the surface recess and the second fluid passageway are each provided by a slot in the rotor, and wherein the first opening and the second opening are tapered, opening outward to a widest part as the first and second openings pass through the respective first and second ends of the rotor.

19. A pump comprising:

a housing having an interior surface, the housing comprising a first fluid port and a second fluid port; and a rotor installed in the housing, the rotor comprising:

a housing engaging surface area forming a sealing interference fit with the interior surface of the housing;

a surface recess that forms a fluid-conveying chamber with the interior surface of the housing that, on rotation of the rotor within the housing, conveys fluid from the first fluid port to the second fluid port;

a first means for providing fluidic communication between the surface recess and the first fluid port of the housing; and a second means for providing fluidic communication between the surface recess and the second fluid port of the housing, wherein the rotor is twisted about a longitudinal axis of rotation, such that a first end and a second end of the rotor are rotationally offset relative to one another by at least 10 degrees.

20. A pump comprising:

a housing having an interior surface, the housing comprising a first fluid port and a second fluid port; and a rotor installed in the housing, the rotor comprising:

a housing engaging surface area forming a sealing interference fit with the interior surface of the housing;

a surface recess that forms a fluid-conveying chamber with the interior surface of the housing that, on rotation of the rotor within the housing, conveys fluid from the first fluid port to the second fluid port;

a first fluid passageway extending partially through the surface recess and having a first opening at a first end of the rotor, the first end defining a hollow interior, the first end comprising a drive shaft extending within the hollow interior, the first opening radially outward of the drive shaft, the first opening being in fluidic communication with the first fluid port of the housing; and a second fluid passageway extending partially through the surface recess and having a second opening at a second, opposite, end of the rotor, the second opening being in fluidic communication with the second fluid port of the housing.

* * * * *